United States Patent [19]

Butler

[11] 4,098,664

[45] Jul. 4, 1978

[54] ROTATING VERTICAL PLATING TABLE

[76] Inventor: Richard E. Butler, 801 Santa Clara Ave., Apt. A, Alameda, Calif. 94501

[21] Appl. No.: 818,356

[22] Filed: Jul. 25, 1977

[51] Int. Cl.[2] ..... C25D 17/06; C25D 7/04

[52] U.S. Cl. ..... 204/212; 204/26

[58] Field of Search ..... 204/26, 212, 215, 297 R

[56] References Cited

U.S. PATENT DOCUMENTS

| | | | |
|---|---|---|---|
| 2,206,908 | 7/1940 | Lunt | 204/212 |
| 3,313,715 | 4/1967 | Schwartz, Jr. | 204/26 |
| 3,445,372 | 5/1969 | Fromson | 204/212 |
| 3,669,867 | 6/1972 | Adachi | 204/224 |
| 3,751,343 | 8/1973 | Macula et al. | 204/15 |

*Primary Examiner*—T. M. Tufariello

*Attorney, Agent, or Firm*—R. S. Sciascia; Charles D. B. Curry; Francis I. Gray

[57] ABSTRACT

A rotating vertical plating table for electroplating workpieces having interior cylindrical surfaces. An approximately circular worktable is rotatably mounted upon a hollow body and has a central hole which connects to a tube which passes through the hollow body. Excess plating chemicals drain through the central hole and tube and are caught by a catch tray supported underneath the hollow body. The excess plating chemicals are recirculated to a plating anode. A ground plate is attached to the underside of the worktable and makes the workpiece which is attached to the worktable the plating cathode.

10 Claims, 4 Drawing Figures

ROTATING VERTICAL PLATING TABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to electroplating worktables, and more particularly to a rotating vertical electroplating table for plating workpieces having interior cylindrial surfaces.

2. Description of the Prior Art

For rotating machinery, especially high speed machinery, the bearing surfaces of the end bells which support one end of the rotating shaft must be maintained within close tolerances to prevent vibration. During use these surfaces become eroded and out of round and must be replated to brought back within tolerance. Previously, these end bells were mounted in a lathe with a catch tray underneath the rotating workpiece and a splash shield wrapped around the workpiece. Even with these precautions a large amount of the plating chemicals is lost. Also, the size of the workpiece with can be plated is limited, and the set up time is long.

SUMMARY OF THE INVENTION

Accordingly, the present invention provides a rotating vertical plating table for electroplating workpieces having interior cylindrical surfaces. An approximately circular worktable with a corrosion resistance coating on the work surface has a central hole with a corrosion resistant lining. A hollow body rotatably supports a hollow vertical shaft internal to the body which is attached to the underside of the worktable such that the central hole is alined with the axial hole through the shaft. A tube of a non-corrosive material connects with the central hole and passes axially through the hollow shaft. A catch tray is supported beneath the body to catch excess plating chemicals which drain from the worktable through the central hole and the tube. A pump provides a means for recirculating the plating chemicals from the catch tray to a plating anode which has a d.c. voltage applied to it from a d.c. power supply. A grand plate is attached to the under side of the worktable and electrically connected to the opposite polarity terminal of the d.c. power supply which makes the workpiece, mounted in physical contact with the worktable, the plating cathode.

Therefor, it is an object of the present invention to provide a rotating vertical plating table for electroplating workpieces interior cylindrical surfaces.

It is another object of the present invention to provide a rotating vertical plating table which saves the plating chemicals used.

Still another object of the present invention is to provide a rotating vertical plating table which minimizes the set up time between jobs.

Other objects, advantages and novel features of the present invention will be apparent from the following detailed description when read in conjunction with the claims and attached drawing.

DESCRIPTION OF THE PREFERRED EMBODIMENT

Figure 1:
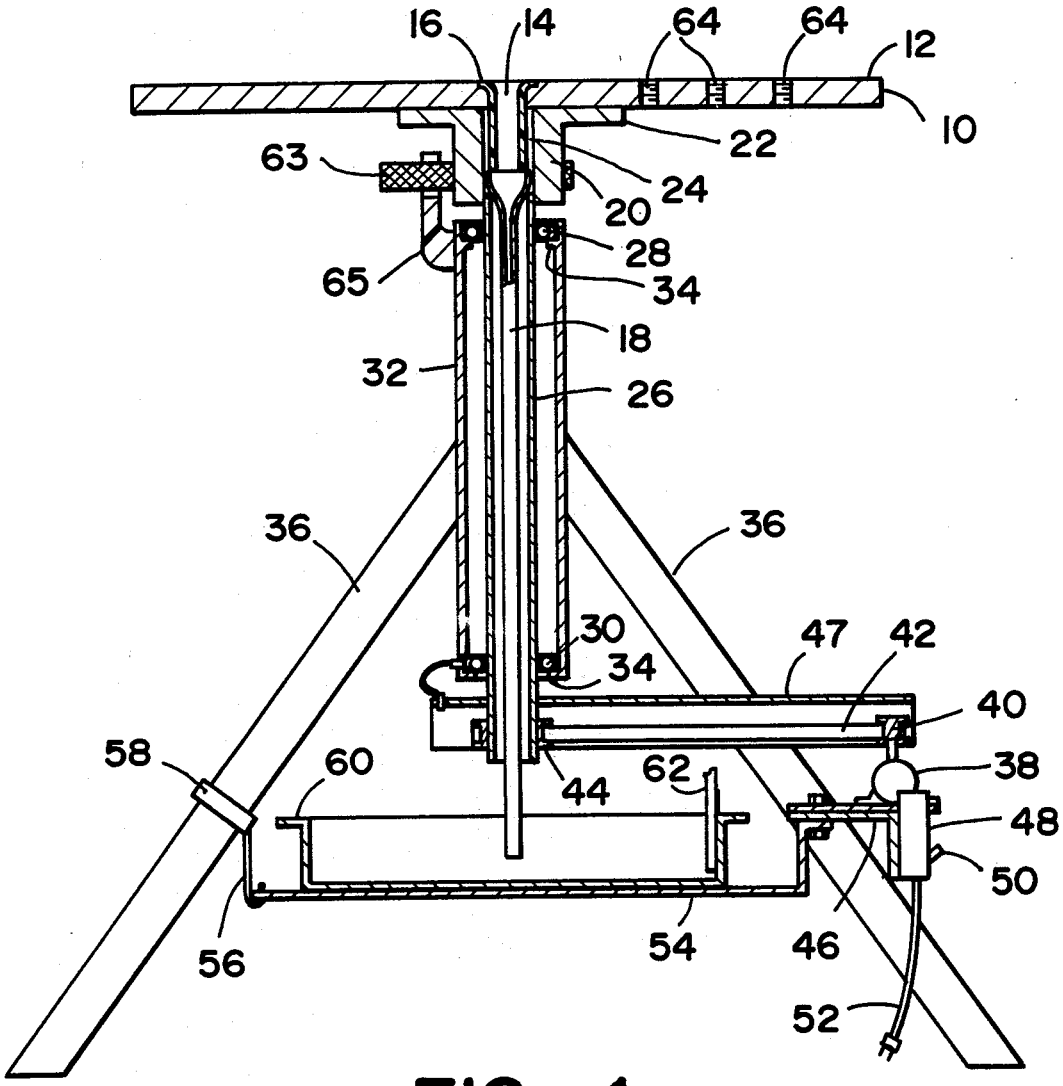
FIG. 1 is a cross-sectional view of a rotating vertical plating table according to the present invention.

Referring now to FIG. 1 an approximately circular worktable 10, made from an electrically conductive material such ⅜ inch steel plate, has one surface coated with a corrosion resistant material, such as an epoxy resin, to form the work surface 12. A central hole 14 through the axis of the worktable 10 has a corrosion resistant lining 16, such as a press-fitted Teflon sleeve, which provides a funnel-shaped opening at the work surface 12 and protrudes below the worktable. A corrosion resistant tube 18 of a material such at Tygon is press-fitted over the protruding end of the lining 16. A ground plate 20 with a flange 22 is fixedly attached by the flange to the underside of the worktable 10 and has an axial hole 24 into which the protruding end of the lining 16 fits with the tube 18 extending from the hole. A hollow shaft 26 is fixedly attached to the ground plate 20 by any suitable means and has a bearing fixedly attached to the shaft near one end. A second bearing 30 is fixedly attached to the shaft 26 near the other end. The bearings 28, 30 may be made of an electrically non-conductive material.

A hollow body 32 encloses the shaft 26 and has ridges 34 which support the bearings 28, 30 to prevent vertical downward movement by the shaft. A non-conductive bushing may be used to electrically insulate the bearings 28, 30 from the body 32 if the bearings are not made of a non-conductive meterial. Legs 36 attached to the exterior of the body 32 provide stable support to the body and the worktable 10 which is rotatably supported by the body as described above.

A motor-pulley arrangement can be used to rotate the shaft 26, thus the worktable 10, although other means may be used. A motor 38 drives a pulley 40 which is connected by a continuous belt 42 to a shaft pulley 44 which is fixedly attached to the lower end of the shaft 26. The motor 38 is mounted on a support member 46 which may be a piece of angle iron attached between two of the legs 36. A sheet metal pulley guard 47 is fixedly mounted between the body 32 and one of the legs 36 to cover the pulley belt 42 as a safety measure for the operator. Also mounted on the support member 46 is a control box 48 to which electric power is supplied, such as by a line cord 52 which can be plugged into an a.c. electrical outlet. A switch 50 mounted in the control box 48 turns on/off the power from the line cord 52, and outlet plugs on the control box may be provided for use by other electrical devices. Appropriate electrical fusing may also be provided in the control box 48.

A platform 54 is connected at one end to the support member 46 and at the other end to one of the legs 36 by any suitable means such as a braid 56 and clamp 58 arrangement. On the platform 54 is situated a catch tray 60 of a corrosion resistant material, placed to be directly under the end of the tube 18. An outlet tube 62 is fixedly attached to one interior corner of the catch tray 60, with one end near the bottom of the tray and the other end above the top of the tray.

Figure 2:
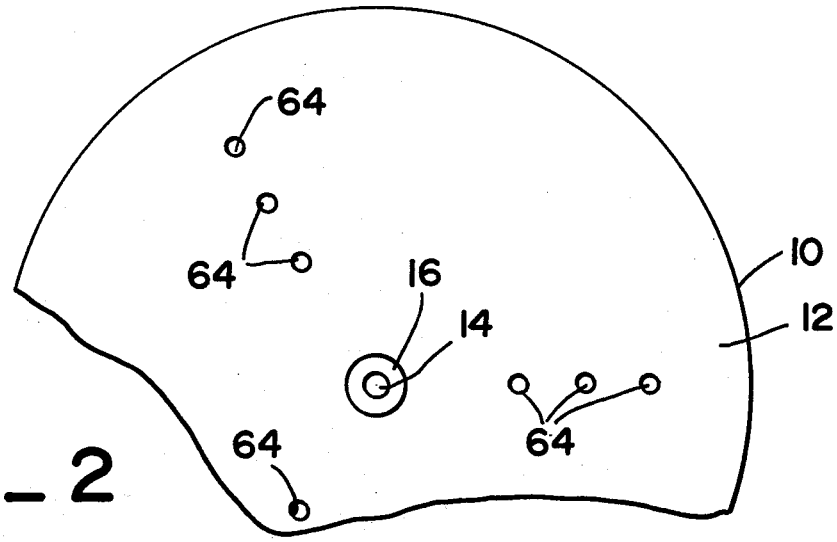
FIG. 2 is a top plan view of the worktable of the rotating vertical plating table according to the present invention.

Means for attaching a workpiece to the worktable 10, such as tapped holes 64 symmetrically arranged as shown in FIG. 2, are incorporated in the worktable. Also, slidingly attached to the ground plate 20 is a ground strap 63 which is held in place by an insulator 65 fixedly attached to the upper exterior portion of the body 32.

Figure 3:
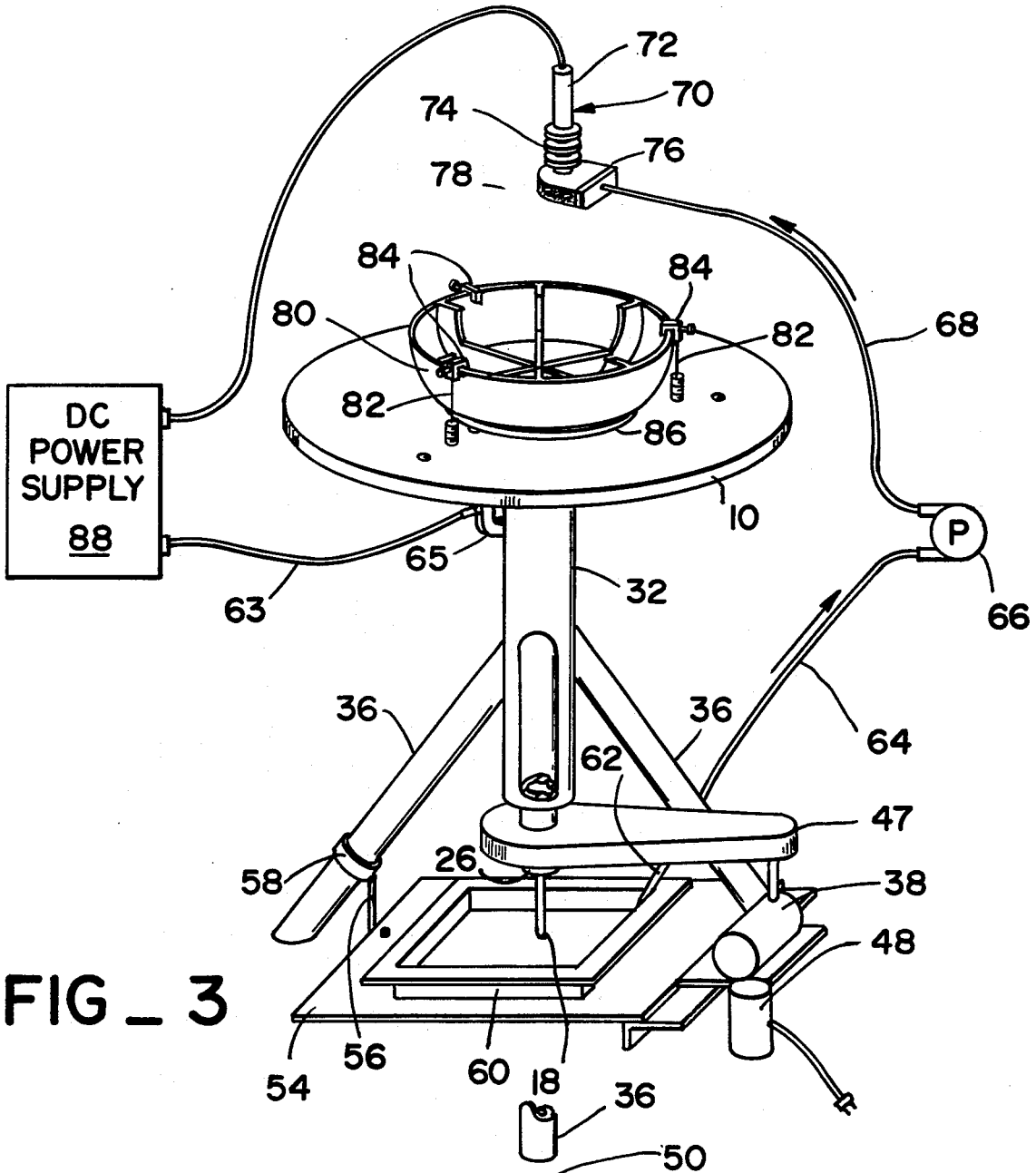
FIG. 3 is a schematic view of the rotating vertical plating table according to the present invention.

In operation preparation (cleaning) chemicals are mixed in a separate catch tray 60 and are not recirculated since they cannot be reused. After cleaning of the surface to be plated, the plating (metal) chemicals are mixed in another catch tray 60 so as not to contaminate the plating chemicals with the preparation chemicals and the outlet tube 62 is connected by suitable means such as a non-corrosive hose 64 to a pump 66 which pumps the chemicals via a second hose 68 to a plating anode 70 as shown in FIG. 3. The anode 70 may be hand held and have an insulated handle 72, heat dissipating fins 74 and a hollow block 76 into which the chemicals are pumped. The block 76 has holes in its face through which the chemicals flow, the face being covered by a porous applicator 78 to provide a uniform distribution of the chemicals on the surface to be plated. The workpiece 80 is secured to the worktable 10 by means such as nuts and bolts 82 with hold-down clamps 84 as illustrated, or the use of clamps and ground straps between the clamps and the worktable for large workpieces, to assure good electrical contact between the workpiece and the worktable. A gasket 86 may be placed between the workpiece 80 and the worktable 10, or in some cases where the surface to be plated is elevated above the worktable a funnel of a non-corrosive material may be used to confine the excess plating chemicals to the region of the central hole 14. In the event there is no hole in the workpiece through which the excess chemicals may flow, a second pump may be used to pump the chemicals from the interior of the workpiece 80 to the catch tray 60.

A d.c. power pack 88 with a one-half cycle circuit breaker which turns off the power pack before spark discharge occurs, as a safety precaution for the operator, provides the high d.c. current required for the electroplating operation. The negative terminal of the power pack 88 is connected to the ground strap 63 which through sliding contact with the ground plate 20 makes the workpiece 80 the cathode. The positive terminal of the power pack 88 is connected to the plating anode 70 so that the d.c. circuit is completed when the anode is brought into contact with the cathodic workpiece 10 durng the electroplating process. For those chemicals requiring a reverse current to clean the surface to be plated, a reversing switch may be provided on the power pack 88. The worktable 10 is driven by the motor 38 to operate at a constant speed such as 60 rpm. A rheostat control may also be provided to vary the speed of the motor 38 as desired.

Figure 4:
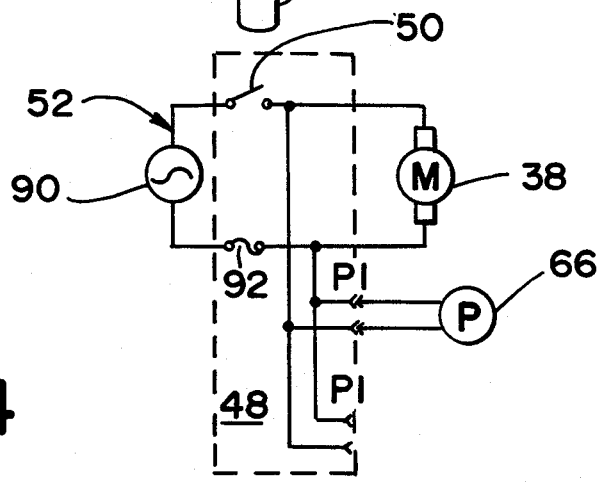
FIG. 4 is an a.c. electrical schematic of the rotating vertical plating table according to the present invention.

FIG. 4 shows the a.c. electrical circuit supplied from an a.c. source 90 to the line cord 52. A fuse 92 is provided as well as auxiliary plugs P1, P2 to which the pump 66 may be electrically connected. The switch 50 controls the power to the motor 38 as well as the plugs P1, P2.

Thus, the present invention provides a rotating worktable for electroplating workpieces with interior cylindrical surfaces which requires little setup time (10 minutes verses 2 hours) and conserves the plating chemicals (98% at least) while accommodating larger workpieces.

What is claimed is:

1. A rotating vertical plating table comprising:
- a. a body having an axial hole therethrough;
- b. an approximately circular worktable of electrically conductive material with a corrosion resistant coating on one side to form a working surface, said worktable having a central hole and being rotatably mounted on said body such that said axial hole is alined with said central hole;
- c. means for fixedly supporting said body;
- d. means for rotating said worktable relative to said body about the central axis of said worktable;
- e. a catch tray situated beneath said axial hole to catch material which flows from said worktable through said central hole and said axial hole; and
- f. means for electrically grounding said worktable.

2. A rotating vertical plating table as recited in claim 1 further comprising means for recirculating said material from said catch tray to a plating anode.

3. A rotating vertical plating table as recited in claim 2 further comprising:
- a. a lining of a non-corrosive material securely fitted in said central hole, one end of which protrudes below said worktable; and
- b. a tube of a non-corrosive material securely fitted over the protruding end of said lining and extending through said axial hole to said catch tray.

4. A rotating vertical plating table as recited in claim 3 further comprising means for electrically insulating said body from said worktable.

5. A rotating vertical plating table as recited in claim 4 further comprising means for controlling said rotating means and said recirculating means.

6. A rotating vertical plating table as recited in claim 5 wherein said electrically grounding means comprises:
- a. a ground plate fixedly attached in electrical contact with the underside of said worktable having a hole therethrough alined with said central and said axial holes; and
- b. a ground strap in sliding contact with said ground plate to which one terminal of a d.c. power supply may be connected.

7. A rotating vertical plating table as recited in claim 6 further comprising:
- a. a hollow shaft fixedly attached at one end to said ground plate and situated within said axial hole with the other end protruding below said body;
- b. a bearing fixedly attached to the exterior of said shaft to provide rolling contact with the interior of said body;
- c. a ridge fixedly attached interior to said body adjacent to said bearing to prevent downward vertical motion of said shaft; and
- d. means for connecting said rotating means to the protruding end of said shaft to provide rotation to said shaft and attached worktable.

8. A rotating vertical plating table as recited in claim 7 further comprising means for a workpiece in electrical contact with said worktable.

9. A rotating vertical plating table as recited in claim 8 wherein said connecting means comprises a shaft pulley fixedly attached to said shaft.

10. A rotating vertical plating table as recited in claim 8 wherein said rotating means comprises:

a. an electrical motor fixedly attached to said supporting means;
b. a motor pulley fixedly attached to the shaft of said motor; and
c. a continuous belt is frictional contact with said shaft pulley and said motor to convert the rotational motion of said motor shaft to rotational motion of said hollow shaft.

* * * * *